US005897058A

United States Patent [19]

Coldren et al.

[11] Patent Number: 5,897,058

[45] Date of Patent: Apr. 27, 1999

[54] HIGH PRESSURE METAL TO METAL SEALING LAND IN A CONTROL VALVE FOR A FUEL INJECTOR

[75] Inventors: Dana R. Coldren, Fairbury; Charles D. Ellenbecker, Normal, both of Ill.; Ching W. Jaw, Phoenix, Ariz.

[73] Assignee: Caterpillar Inc., Peoria, Ill.

[21] Appl. No.: 08/935,070

[22] Filed: Sep. 25, 1997

[51] Int. Cl.[6] ..... F02M 51/06

[52] U.S. Cl. ..... 239/88; 239/127; 239/585.4

[58] Field of Search ..... 239/585.1–585.5, 239/88, 93, 95, 124, 127; 299/630, 636

[56] References Cited

U.S. PATENT DOCUMENTS

| | | | |
|---|---|---|---|
| 1,659,677 | 2/1928 | Welsch | 277/636 |
| 2,071,322 | 2/1937 | Balfe | 288/1 |
| 2,136,835 | 11/1938 | Begg | 277/630 |
| 2,737,405 | 3/1956 | Shinn | 288/24 |
| 4,516,784 | 5/1985 | Merz | 277/180 |
| 4,528,959 | 7/1985 | Hauser, Jr. | 123/470 |
| 4,717,118 | 1/1988 | Potter | 251/129.02 |
| 4,869,462 | 9/1989 | Logie et al. | 251/129.16 |
| 5,121,929 | 6/1992 | Cobb | 277/2 |
| 5,169,066 | 12/1992 | Ricco et al. | 239/46 |
| 5,407,131 | 4/1995 | Maley et al. | 239/90 |
| 5,476,245 | 12/1995 | Augustin | 239/93 X |
| 5,494,219 | 2/1996 | Maley et al. | 239/88 |

*Primary Examiner*—Kevin Weldon
*Attorney, Agent, or Firm*—Michael McNeil

[57] ABSTRACT

A control valve includes a first valve body component that defines an outlet passage and a first planar surface surrounding a valve seat. A second valve body component has a second planar surface and is fastened against the first valve body component with the second planar surface in contact with the first planar surface at a sealing land. The first valve body component and the second valve body component define a high pressure cavity surrounded by the sealing land. One of the first valve body component and the second valve body component define an inlet passage opening to the high pressure cavity. A valve member has a portion positioned in the high pressure cavity and is moveable between a closed position in which the valve member contacts the valve seat closing the outlet passage to the high pressure cavity, and an open position in which the outlet passage is open to the high pressure cavity. The sealing land has a symmetrical non-circular shape.

20 Claims, 6 Drawing Sheets

Fig_2_
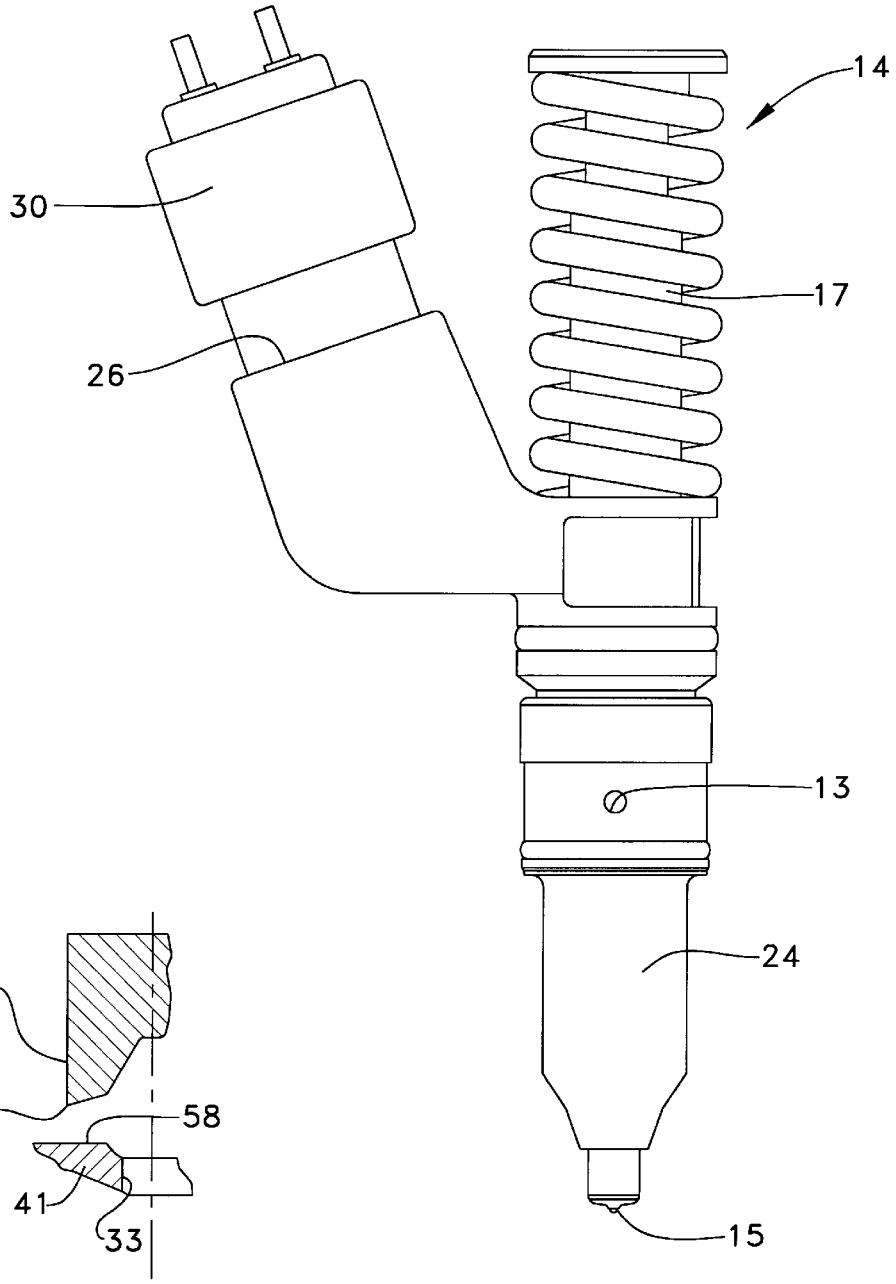
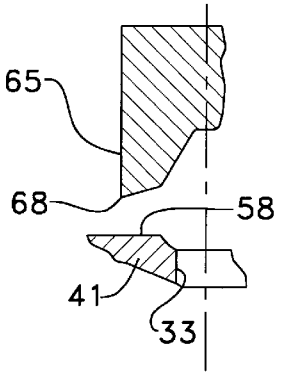
Fig_4_

HIGH PRESSURE METAL TO METAL SEALING LAND IN A CONTROL VALVE FOR A FUEL INJECTOR

TECHNICAL FIELD

The present invention relates generally to control valves, and more particularly to high pressure metal to metal sealing lands in control valves for fuel injectors.

BACKGROUND ART

Examples of electronically controlled cartridge control valves for fuel injectors are shown in U.S. Pat. No. 5,494,219 to Maley et al., U.S. Pat. No. 5,407,131 to Maley et al., U.S. Pat. No. 4,869,462 to Logie et al., and U.S. Pat. No. 4,717,118 to Potter. In each of these examples, the injector includes a mechanically actuated fuel pumping plunger and an electronically actuated fuel pressure control valve assembly. The pressure control valve assembly includes a solenoid operated poppet valve member that controls fuel pressure in the injector in order to control fuel injection delivery and timing. Fuel pressure is controllably enabled to be developed within the injector by electrical actuation of the pressure control valve assembly. Fuel pressure is controllably prevented from developing within the injector by not electrically actuating the pressure control valve so that fuel can spill through a return passage while the plunger is undergoing a portion of its downward pumping stroke.

In such electronically controlled fuel injectors, the armature of the pressure control valve assembly moves the poppet valve member in one direction until it engages a valve seat, and holds the poppet valve in its closed position to enable fuel pressure to be developed in the injector, eventually resulting in fuel injection. At the end of the fuel injection cycle, the solenoid is de-energized, and a return spring moves the poppet valve member off the valve seat, returning the poppet valve member to its open position, which relieves fuel pressure by spilling the fuel back to a fuel reservoir.

Because of manufacturing and cost constraints, the valve must typically include several valve body components joined to one another. In most cases, a sealing land defining the contact area between two valve body components must withstand cyclic high fuel pressures without leaking. These pressures typically vary on the order from about 0 psi to 20,000 psi, or more, many times per second, and the sealing land must reliably seal against leakage over many hundreds of millions of injection pressure cycles. Because of the large number of cycles involved and the relatively high pressures, conventional o-ring and/or gasket sealing techniques are incapable of reliably sealing against leakage in this extreme environment. In other words, engineers must typically rely upon a metal to metal sealing land to adequately and reliably prevent leakage in some high pressure areas within control valves for fuel injectors.

Although machining technology is sufficiently developed to allow adequate high pressure sealing between two planar surfaces of a pair of metal valve body components, the ability to provide an adequate force to hold the two valve body components together sufficiently to prevent leakage is somewhat more problematic. In the case of cartridge control valves for fuel injectors, this force is often produced by relying upon a relatively high torque when attaching the control valve to an injector body. High torques can lead to excessive stress on the metal parts and cause distortion of the matched clearance bores. This in turn can cause parts to break and/or the distortion can cause a seizure of moving components within the fuel injector. Any improvement that reduces the amount of force necessary to hold two metallic valve body components together is desirable because of the decreased sensitivity to reliance upon high joining forces.

The present invention is directed to overcoming one or more of the problems as set forth above.

DISCLOSURE OF THE INVENTION

In one embodiment, a control valve includes a first valve body component defining an outlet passage and a first planar surface surrounding a valve seat. A second valve body component has a second planar surface and is fastened against the first valve body component with the second planar surface in contact with the first planar surface at a sealing land. The first valve body component and the second valve body component define a high pressure cavity surrounded by the sealing land. One of the first valve body component and the second valve body component define an inlet passage opening to the high pressure cavity. A valve member has a portion positioned in the high pressure cavity and is moveable between a closed position in which the valve member contacts the valve seat closing the outlet passage to the high pressure cavity, and an open position in which the outlet passage is open to the high pressure cavity. The sealing land has a symmetrical non-circular shape.

In another embodiment of the present invention, the valve seat is a planar valve seat and the valve member includes an annular knife edge that seats against the planar valve seat to close the outlet passage to the high pressure cavity when in its closed position. The valve member can also be moved to an open position in which an annular knife edge is away from the planar valve seat. In this embodiment, the inlet passage has a straight centerline opening to the high pressure cavity.

In still another embodiment of the present invention, an injector body defines a fuel inlet, a nozzle outlet, a cartridge opening, and further defines a spill passage and a return passage that open into the cartridge opening. A cartridge control valve is received in the cartridge opening and attached to the injector body. The cartridge control valve includes a first valve body component held in contact with a second valve body component to define a high pressure cavity surrounded by a sealing land. The cartridge control valve defines a portion of an outlet passage that opens on one end to the high pressure cavity and on an other end to the return passage. The cartridge control valve also defines a portion of an inlet passage that opens on one end to the high pressure cavity and on an other end to the spill passage. The valve member has a portion positioned to reciprocate in the high pressure cavity between an open position in which the inlet passage is open to the outlet passage, and a closed position in which the outlet passage is closed to the inlet passage. The sealing land lies in a plane and has a symmetrical non-circular shape.

BRIEF DESCRIPTION OF THE DRAWINGS

FIG. 2 is an elevational view of a fuel injector incorporating a cartridge control valve according to one embodiment of the present invention.

FIG. 4 is a fragmented sectional view illustrating a flat valve seat and knife edge valve member in accordance with one aspect of the present invention.

BEST MODE FOR CARRYING OUT THE INVENTION

Figure 1:
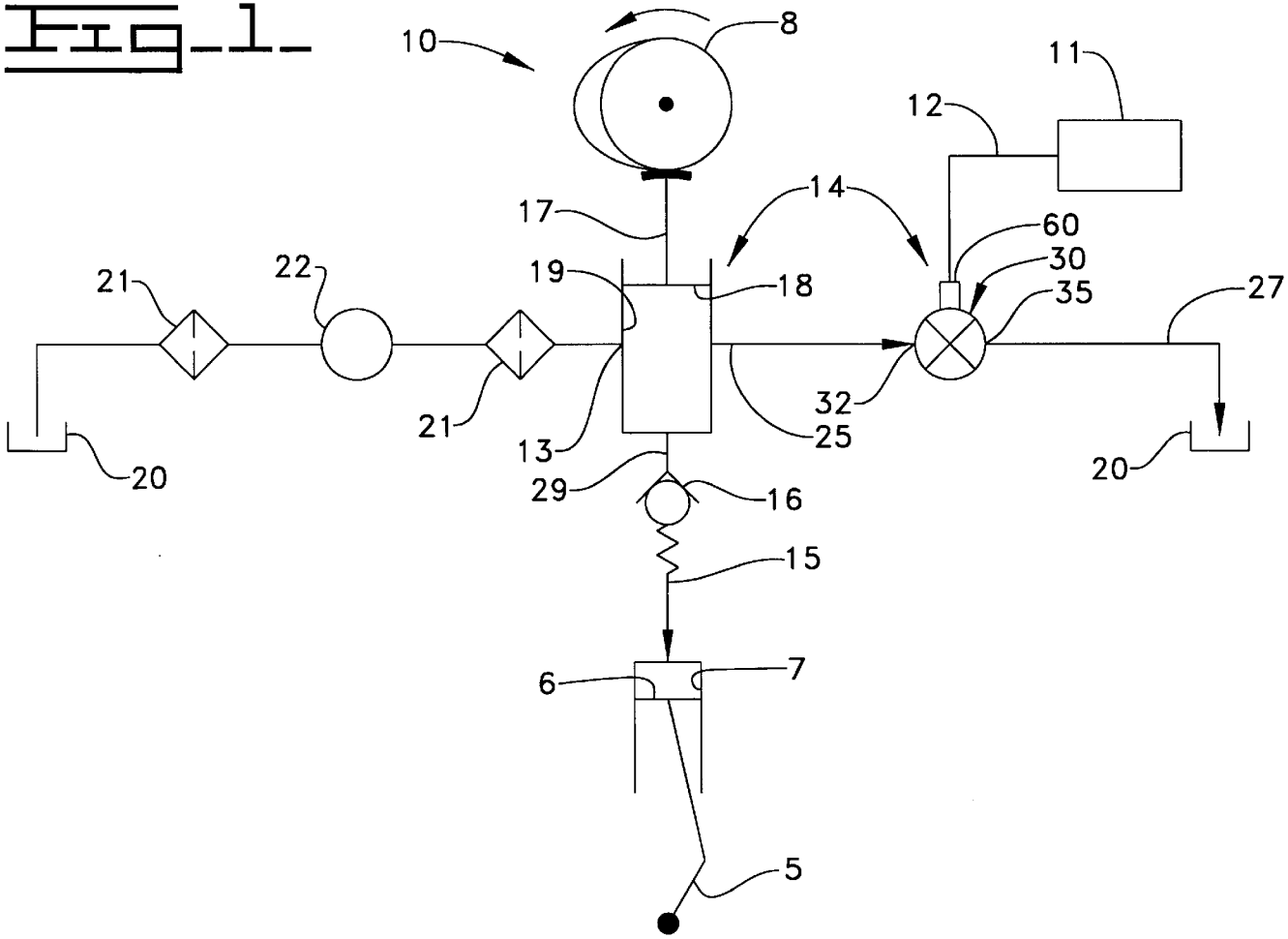
FIG. 1 is a schematic diagram illustrating a mechanically actuated electronically controlled fuel injection system.

In the drawings, the same reference numerals designate the same elements for features throughout all of the drawings.

Referring now to FIG. 1, there is illustrated an injector fuel system 10 adapted for a diesel-cycle direct-injection internal combustion engine having a number of engine pistons, only one of which is shown, i.e. piston 6. Each engine piston and corresponding engine cylinder would have a different fuel injector 14. Each engine piston 6 reciprocates in a separate cylinder 7 due to rotation of the engine drive shaft 5 in a conventional manner. Drive shaft 5 also rotates cam 8 which acts upon a tappet 17 of each injector 14 to mechanically actuate the injectors with each revolution of the engine.

Fuel injection system 10 includes a fuel source or tank 20. Fuel is drawn from fuel tank 20 by a relatively low pressure transfer pump 22, which carries the fuel through one or more fuel filters 21 to the fuel inlet 13 of each injector 14. With each revolution of cam 8, tappet 17 drives a pump piston 18 downward in pump chamber 19. Pump chamber 19 is connected to a spill passage 25 and a nozzle chamber 29 within injector 14. When fuel pressure within pumping chamber 19 is above a valve opening pressure, needle check valve 16 opens and fuel commences to spray into cylinder 7 through nozzle outlet 15. The fuel is prevented from reaching the valve opening pressure as long as spill passage 25 is open.

Spill passage 25 is connected to an inlet passage 32 of cartridge control valve 30. An outlet passage 35 from cartridge control valve 30 is connected to a return passage 27, which in turn is connected back to fuel tank 20 for recirculation. Fuel injection is controlled by opening and closing cartridge control valve 30 to open and close fluid communication between inlet passage 32 and outlet passage 35. In this case, inlet passage 32 passes completely through valve body component 41 and has a straight center line 39. Corners in a high pressure passage are undesirable because cracks can sometimes develop over time. This opening and closing of cartridge control valve 30 is controlled by a conventional electronic control module 11 that commands the energization or de-energization of a solenoid 60 via a communication line 12 in a conventional manner.

Referring now to FIG. 2, an example injector 14 according to the present invention is illustrated. Fuel injector 14 includes an injector body 24, a fuel inlet 13, a nozzle outlet 15 and a cartridge opening 26 formed in injector body 24. A cartridge control valve 30 is received in cartridge opening 26 and attached to injector body 24.

Figure 3:
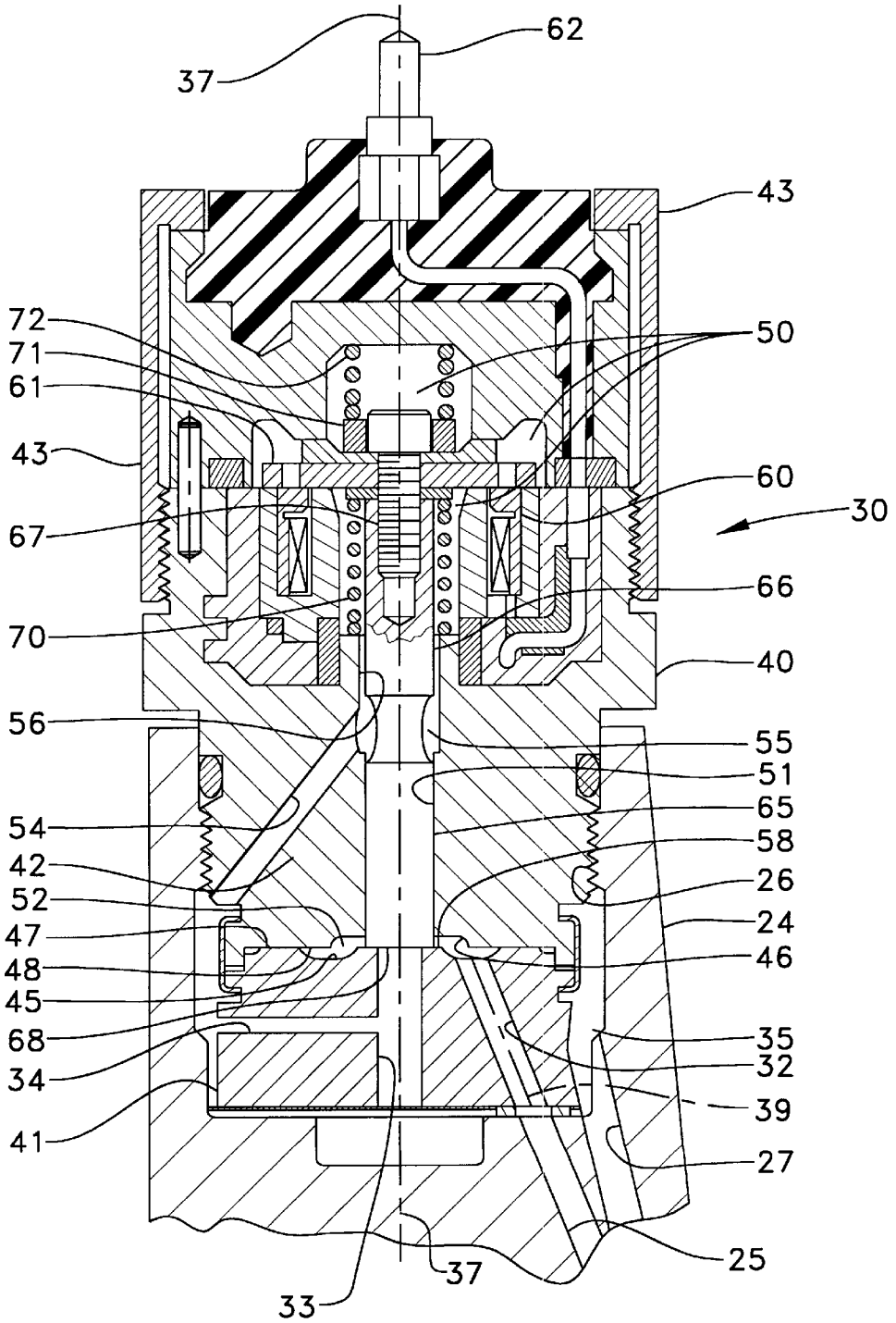
FIG. 3 is a sectioned side elevational view of a cartridge control valve according to the present invention.

Referring now to FIG. 3, the inner structure of cartridge control valve 30 is illustrated. Cartridge control valve 30 includes a valve body made up of a plurality of generally cylindrically shaped body components 40, 41 and 43 that are attached to one another along a center line 37 in a manner well known in the art. In this case, cap body component 43 holds the top portion of control valve 30 together, and the complete assembly is attached to injector body 24 via external threads on valve body component 42 and matched internal threads in cartridge opening 26. When cartridge control valve 30 is attached to injector body 24, its inlet passage 32 is connected to a spill passage 25, which is connected to the pump chamber within the injector as discussed earlier. Also, an annular outlet passage 35 is connected to a return passage 27. A poppet valve member 65 is mounted within the valve body and reciprocates between an open position in which annular outlet passage 35 is open to inlet passage 32 via a vertical outlet passage 33 and a plurality of horizontal outlet passages 34, only one of which is shown. Poppet valve member 65 can also be moved downward by solenoid 60 to a closed position in which inlet passage 32 is closed to annular outlet passage 35.

The various body components of cartridge control valve 30 are preferably attached to one another in a way that seals against leakage of fuel out of cartridge control valve 30. The valve body defines a solenoid cavity 50 within which is mounted a solenoid 60. Poppet valve member 65 is attached to armature 61 of solenoid 60 via a conventional screw 67. A metering passage 54 extends between solenoid cavity 50 and annular outlet passage 35 so that solenoid cavity 50 is wetted but is sealed against leakage to the outside of cartridge control valve 30 in a conventional manner. In this embodiment, a portion of metering passage 54 includes a diametrical clearance area 56 that is located between a portion 66 of poppet valve member 65 and an enlarged diameter portion 56 of guide bore 51.

A return spring 70 normally biases poppet valve member 65 upward to its open position. The upward force of return spring 70 is trimmed during manufacture of cartridge control valve 30 through the use of a relatively weak trimming spring 72 and trimming spacer 71 in a conventional manner.

Referring now also to FIG. 4, valve body component 41 is machined to include a relatively flat annular seating surface 58 that defines a portion of a spill cavity 52 defined by the joinder of valve body components 41 and 42. Valve body components 41 and 42 are held together when control valve 30 is torqued into cartridge opening 26 of injector body 24. One end of poppet valve member 65 is machined to include an annular knife edge valve surface 68 that closes spill cavity 52 to vertical outlet passage 33 when seated against flat seating surface 58. Thus, return spring 70 normally biases annular knife edge 68 away from flat seating surface 58 as shown in FIG. 4; however, when solenoid 60 is energized, poppet valve member 65 is pulled downward to seat annular knife edge 68 against flat seating surface 58 to close fluid communication between inlet passage 32 and outlet passages 33, 34 and 35. Poppet valve member 65 is preferably hydraulically balanced by having a first hydraulic surface area exposed to fluid pressure in solenoid cavity 50 that is about equal to a second hydraulic surface area that is exposed to fluid pressure in vertical outlet passage 33. Thus, except for fluid pressure gradients existing between solenoid cavity 50 and vertical outlet passage 33, the only forces acting on poppet valve member 65 should originate from solenoid 60, return spring 70 and trimming spring 71.

Although the high fuel pressures existing in inlet passage 32 and spill cavity 52 during an injection event will inevitably cause a small amount of fuel to leak along the outer surface of poppet valve member 65 along guide bore 51, solenoid cavity 50 is substantially isolated from inlet passage 32 when poppet valve member 65 is in its closed position. However, when poppet valve member 65 is in its open position, solenoid cavity 50 is in fluid communication with inlet passage 32 via spill cavity 52, vertical spill passage 33, horizontal spill passages 34, outlet passages 35 and most importantly metering passage 54. The use of a wetted solenoid cavity 52 permits the fuel within solenoid cavity 50 to damp the movement of poppet valve member 65 so that it does not bounce back toward its closed position upon contacting its back stop at its open position. Metering passage 54 also serves to relieve any excess fluid pressure in solenoid cavity 50 so that poppet valve member 65 remains hydraulically balanced.

Figure 5:
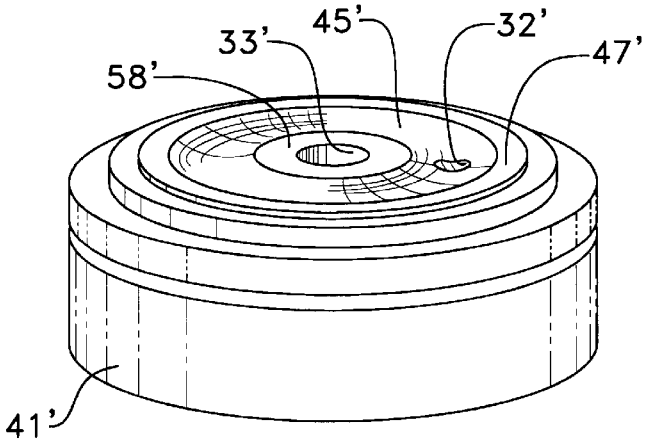
Fig 5 (PRIOR ART)
FIG. 5 is an isometric view of a valve body component according to the prior art.
Figure 6:
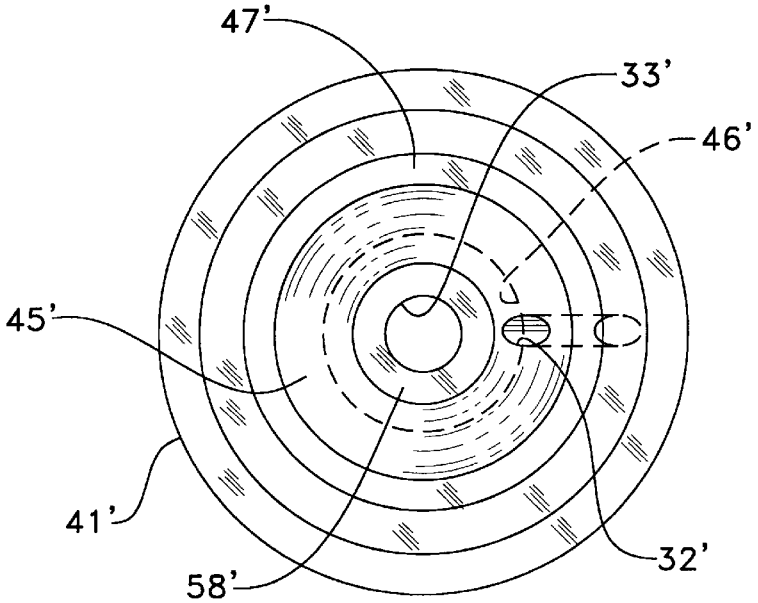
Fig 6 (PRIOR ART)
FIG. 6 is a top view of the prior art valve body component shown in FIG. 5.

Referring now to FIGS. 5 and 6, a prior art valve body component 41' is machined from a single cylindrical piece of a suitable metallic alloy to include a vertical outlet passage 33' separated from an annular depression 45' by an annular flat seating surface 58'. An inlet passage 32' opens into annular depression 45'. These features are surrounded by the planar circular sealing land 47' which contacts the underside of valve body component 42 when cartridge control valve 30 is assembled as shown in FIG. 3.

Figure 7:
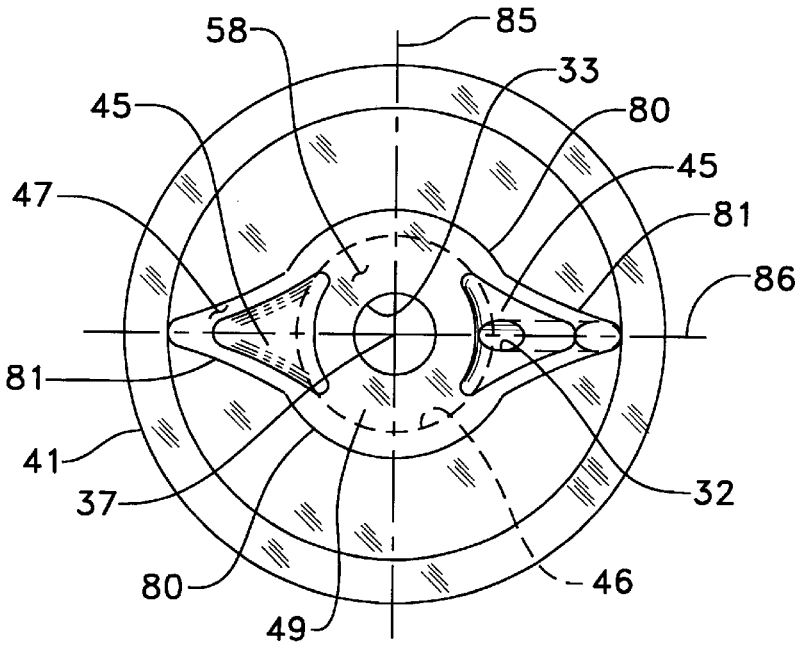
FIG. 7 is a top view of a valve body component according to one aspect of the present invention.

The preferred embodiment of the present invention is modified valve body component 41 as shown in FIG. 7. It includes a vertical outlet passage 33 on centerline 37. Unlike the annular depression 45' of the prior art valve body component 41', valve body component 41 of the present invention is machined to include two identical triangular depressions 45 that are enclosed in two wedge shaped portions 81. Wedge shaped portions 81 and depressions 45 are both symmetrical about axis of symmetry 85 and axis of symmetry 86. An inlet passage 32 opens on one end into one of the depressions 45. As seen in shadow, counter bore 46 and valve body component 42 will allow fluid communication between both depressions 45 (also see FIG. 3). A sealing land 47 includes upper and lower circular arc portions 80 and left and right wedge shaped portions 81. Circular arc portions 80, wedge shaped portions 81 and flat annular seating surface 58 are all portions of raised planar surface 49.

Referring again to FIGS. 5 and 6, circular sealing land 47' of prior art valve body component 41' encompasses a relatively large circular area over which high pressure fluid tends to push the valve body components apart. In the preferred embodiment of the present invention, valve body component 41 has a sealing land 47 that encloses a significantly smaller area than the prior art sealing land. Sealing land 47 is defined by the outer edge of upper and lower circular portions 80 and the outer raised edge of left and right wedge shaped portions 81. The inner perimeter of sealing land 47 is defined by the outer edge of depressions 45 and the counter bore 46 of valve body 42 where it intersects flat annular seating surface 58. Since the area enclosed by sealing land 47 of the present invention is smaller than the area enclosed by the sealing land 47' of the prior art, this translates into less force being needed to hold valve body component 41 against valve body component 42 when control valve 30 is assembled as shown in FIG. 3. This fact flows from the well known equation that force equals pressure times area. Although pressure has not changed between the prior art and the present invention, the force is reduced since the area is reduced. Thus, leakage of fluid across sealing land 47 can be prevented during high pressure cycles while relying upon less force to hold valve body components 41 and 42 together.

Figure 8:
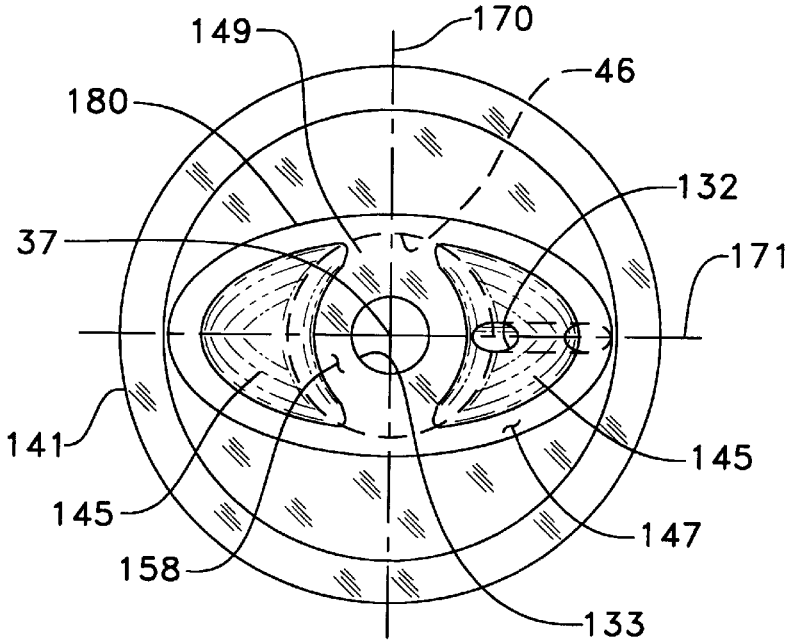
FIG. 8 is a top view of a valve body component according to another aspect of the present invention.
Figure 9:
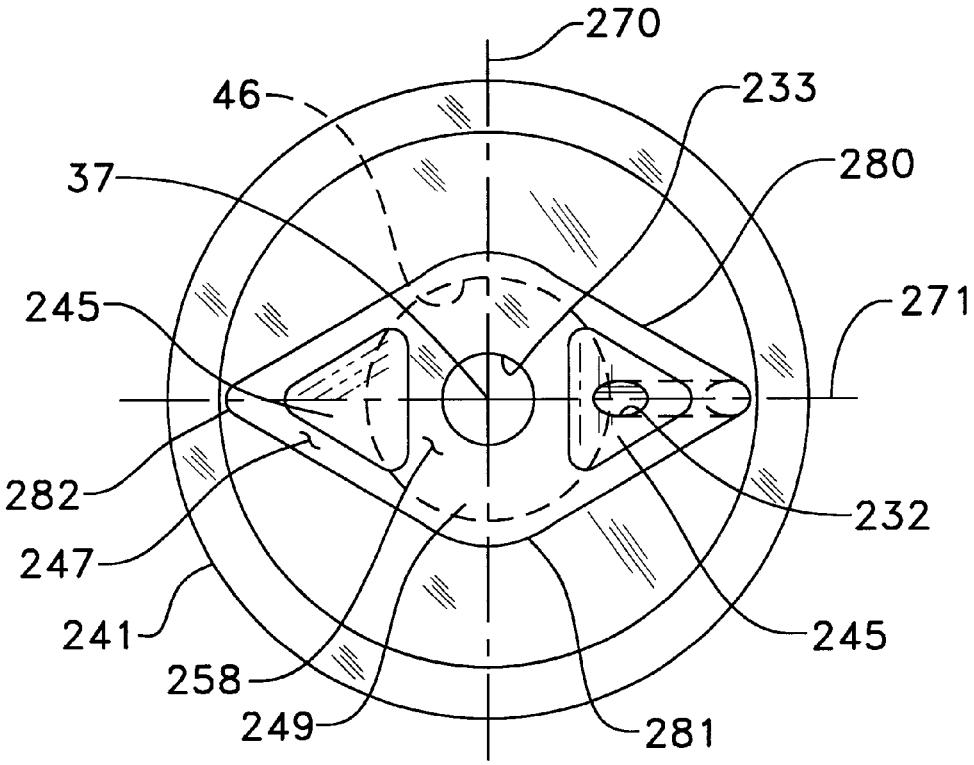
FIG. 9 is a top view of a valve body component according to still another aspect of the present invention.

FIGS. 8 and 9 show two additional embodiments of the present invention as alternatives to the embodiment shown in FIG. 7. An elliptical shaped sealing land is shown in FIG. 8 as valve body component 141 is symmetrical about axis of symmetry 171 and axis of symmetry 170, which intersect at centerline 37. A vertical outlet passage 133 has a centerline 37. Counterbore 46 of valve body component 42 is indicated in shadow to show that both depressions 145 will remain in fluid communication with inlet passage 132 via a connection across counter bore 46. The elliptically shaped sealing land 147 is located within elliptical shaped raised area 180. The planar surface 149 includes elliptically shaped raised area 180 and flat seating surface 158 in the same plane. The elliptically shaped sealing land of FIG. 8 is offered as an alternative to the circular arc/wedge shaped sealing land 47 of FIG. 7, in the event that the latter is more easily machined in some instances. In any event, sealing land 147 is the area of contact between valve body component 141 and valve body component 42 when a control valve is assembled as shown in FIG. 3.

In FIG. 9, valve body component 241 has a diamond shaped sealing land as an alternative to the valve body components 41 and 141 of FIGS. 7 and 8, respectively. Diamond shaped planar surface 249 is symmetrical about axis of symmetry 270 and axis of symmetry 271. Planar surface 249 includes diamond shaped raised area 280 and flat seating surface 258. Fluid communication between depressions 245 is maintained via counter bore 46 in valve body component 42. As in the previous embodiments, valve body component 241 includes a vertical outlet passage 233 having a centerline 37 and an inlet passage 232 that opens into one of the depressions 245. In order to eliminate sharp corners, diamond shaped planar surface 249 and hence diamond shaped sealing land 247 have top and bottom rounded corners 282 as well as side rounded corners 281. As with the previous embodiments, diamond shaped sealing land 247 is defined as that area of contact between valve body component 241 and valve body component 42, when a control valve is assembled as shown in FIG. 3. This diamond shaped sealing land is that area contained within the outer perimeter of raised planar surface 249 but outside of counter bore 46 and the outer edges of depressions 245.

Industrial Applicability

The present invention finds potential application in any fluid valve in which two metallic valve body components are held in contact with one another to define a sealing land that surrounds a high pressure fluid cavity. When high fluid pressure exists in the cavity defined between the two valve body components, the two body components naturally tend to be pushed apart, and leakage will naturally occur unless there is sufficient force holding the two valve body components together. Thus, the force necessary to adequately hold the two valve body components together sufficiently that fluid leakage does not occur is somewhat dependent upon the size of a planar area surrounded by the sealing land. If this area can be reduced, the force necessary to hold the two valve body components together can also be correspondingly reduced. The present invention accomplishes a reduction in the area surrounded by the sealing land by changing the shape of the sealing land from being circular, as in the prior art, to a symmetrical non-circular shape. While such a change in the sealing land shape may not significantly alter, and might even increase, the area of the sealing land itself, the planar area surrounded by the sealing land can be significantly reduced.

In the illustrated embodiments, all of the sealing land shapes are non-circular and symmetrical. In particular, the illustrated embodiments all have two axes of symmetry. The purpose of this symmetry is to insure that the net pressure force acting on each valve body component acts along the centerline 37 of the particular valve body component and perpendicular to a plane defined by the sealing land. This insures a force balance and a balanced distribution of that force all the way around the sealing land. It should be pointed out though, that the present invention could also be accomplished with sealing lands having radial symmetry, with possibly no particular axis of symmetry. For instance, a sealing land having the general shape of an equilateral triangle would exhibit radial symmetry and the net force contained within the sealing land would be distributed in a balanced manner, be aligned with the centerline of the valve body components and be perpendicular to the plane of the sealing land. Although such an equilateral triangle shape would have at least one axis of symmetry, it is possible that a radially symmetrical shape, such as a multi sided polygon, could have no axis of symmetry yet distribute the fluid pressure force around the centerline of the particular valve body components in conformance with the present invention.

While the present invention finds potential application in a wide variety of fluid valves, it finds particular application in control valves for fuel injectors. More particularly, the present invention finds application in cartridge control valves of the type utilized within cam actuated electronically controlled fuel injectors of the type manufactured by Caterpillar, Inc. of Peoria, Ill. In this latter application, the non-circular symmetrical sealing land of the present invention allows for a significant reduction in the torque necessary to attach the cartridge control valve to an injector body while retaining a sufficient joining force that no leakage occurs across the sealing land.

In order to quantify the improvement brought by the present invention, one specific dimensional example can be considered. In this example, a prior art valve body component 41' as shown in FIGS. 5 and 6 has a sealing land area on the order of about 76 square millimeters yet surrounds a high pressure area on the order of about 226 square millimeters. When the valve body component 41 is compared, its sealing land has a larger area, on the order of about 84 square millimeters, yet this sealing land surrounds a high pressure area that is only on the order of about 102 square millimeters. Thus, in many cases, the sealing land of the present invention will have an area greater than about 65 square millimeters yet surround a high pressure planar area that is less than about 120 square millimeters. In the case of this specific example, the torque necessary to hold the valve body components sufficiently to prevent leakage is reduced from 230 Newton-meters for the prior art down to about 165 Newton-meters according to the present invention.

Those skilled in the art will appreciate that numerous modifications and alternative embodiments of the present invention will be apparent in view of the foregoing description. Accordingly, this description is to be construed as illustrative only and is for the purpose of teaching those skilled in the art the best mode of carrying out the invention. The details of the structure may be varied substantially without departing from the spirit of the invention, the scope of which is defined in terms of the claims as set forth below.

What is claimed is:

1. A control valve comprising:

a first valve body component defining an outlet passage and having a first planar surface surrounding a valve seat;

a second valve body component having a second planar surface and being fastened against said first valve body component with said second planar surface in contact with said first planar surface at a sealing land;

said first valve body component and said second valve body component defining a high pressure cavity surrounded by said sealing land;

one of said first valve body component and said second valve body component defining an inlet passage opening to said high pressure cavity;

a valve member with a portion positioned in said high pressure cavity and being movable between a closed position in which said valve member contacts said valve seat closing said outlet passage to said high pressure cavity and an open position in which said outlet passage is open to said high pressure cavity; and said sealing land having a symmetrical non-circular shape.

2. The control valve of claim 1 wherein said inlet passage has a straight centerline and passes completely through said first valve body component.

3. The control valve of claim 1 wherein said sealing land has a first circular arc portion, a second circular arc portion, a first wedge shaped portion and a second wedge shaped portion.

4. The control valve of claim 1 wherein said valve body component includes a raised area; and said first planar surface is located on top of said raised area.

5. The control valve of claim 1 wherein said sealing land has a generally elliptical shape.

6. The control valve of claim 1 wherein said sealing land has a generally diamond shape.

7. The control valve of claim 6 wherein said diamond shape has rounded corners.

8. The control valve of claim 1 wherein said valve seat is annular and planar.

9. The control valve of claim 1 wherein both said first valve body component and said second valve body component have a generally cylindrical outer surface.

10. The control valve of claim 1 wherein said first valve body component contacts said second valve body component over an area greater than about 65 square millimeters; and a planar area surrounded by said sealing land is less than about 120 square millimeters.

11. A control valve comprising:

a first valve body component defining an outlet passage and having a ridge topped by a first planar surface surrounding a planar valve seat;

a second valve body component having a second planar surface and being fastened against said first valve body component with said second planar surface in contact with said first planar surface at a sealing land;

said first valve body component and said second valve body component defining a high pressure cavity surrounded by said sealing land;

said first valve body component defining an inlet passage with a straight centerline opening to said high pressure cavity;

a valve member with a portion positioned in said high pressure cavity that includes an annular knife edge and being movable between a closed position in which said annular knife edge seats against said valve seat closing said outlet passage to said high pressure cavity and an open position in which said annular knife edge is away from said planar valve seat; and said sealing land having a symmetrical non-circular shape.

12. The control valve of claim 11 wherein said sealing land has a first circular arc portion, a second circular arc portion, a first wedge shaped portion and a second wedge shaped portion.

13. The control valve of claim 11 wherein said sealing land has a generally elliptical shape.

14. The control valve of claim 11 wherein said sealing land has a generally diamond shape.

15. The control valve of claim 14 wherein said diamond shape has rounded corners.

16. A fuel injector comprising:

an injector body defining a fuel inlet, a nozzle outlet and a cartridge opening, and further defining a spill passage and a return passage that open into said cartridge opening;

a cartridge control valve received in said cartridge opening and attached to said injector body;

said cartridge control valve including a first valve body component held in contact with a second valve body component to define a high pressure cavity surrounded by said sealing land;

said cartridge control valve defining a portion of an outlet passage that opens on one end to said high pressure cavity and on an other end to said return passage;

said cartridge control valve defining a portion of an inlet passage that opens on one end to said high pressure cavity and on an other end to said spill passage;

a valve member with a portion positioned to reciprocate in said high pressure cavity between an open position in which said inlet passage is open to said outlet passage and a closed position in which said outlet passage is closed to said inlet passage;

said sealing land lying in a plane and having a symmetrical non-circular shape.

17. The fuel injector of claim 16 wherein said sealing land has a first circular arc portion, a second circular arc portion, a first wedge shaped portion and a second wedge shaped portion.

18. The fuel injector of claim 16 wherein said sealing land has a generally elliptical shape.

19. The fuel injector of claim 16 wherein said sealing land has a generally diamond shape.

20. The fuel injector of claim 16 wherein said diamond shape has rounded corners.

* * * * *